US005175239A

United States Patent [19]

Gauntt et al.

[11] Patent Number: 5,175,239

[45] Date of Patent: Dec. 29, 1992

[54] PROCESS FOR MAKING PARA-ARAMID FIBERS HAVING HIGH TENACITY AND MODULUS BY MICROWAVE ANNEALING

[75] Inventors: Sibbley P. Gauntt, Richmond, Va.; Hua-Feng Huang, Chadds Ford, Pa.

[73] Assignee: E. I. Du Pont de Nemours and Company, Wilmington, Del.

[21] Appl. No.: 634,796

[22] Filed: Dec. 27, 1990

[51] Int. Cl.[5] ..... C08G 69/26; B29C 35/02; D01F 6/82; D01P 10/06

[52] U.S. Cl. ..... 528/348; 264/184; 264/210.8; 264/290.5; 264/25

[58] Field of Search ..... 528/348; 264/22, 184, 264/210.8, 211.7

[56] References Cited

U.S. PATENT DOCUMENTS

| | | | |
|---|---|---|---|
| 3,557,334 | 1/1971 | Lewis | 219/10.55 |
| 3,814,793 | 6/1974 | Prince et al. | 264/210 F |
| 3,816,581 | 6/1974 | Prince | 264/233 |
| 3,869,429 | 3/1975 | Blades | 260/785 |
| 3,869,430 | 3/1975 | Blades | 260/785 |
| 4,055,001 | 10/1977 | Forster et al. | 34/1 |
| 4,515,656 | 5/1985 | Memeger, Jr. | 162/101 |
| 4,726,922 | 2/1988 | Cochran et al. | 264/184 |
| 4,859,393 | 8/1989 | Yang et al. | 264/184 |
| 4,883,634 | 11/1989 | Chern et al. | 264/555 |
| 4,985,193 | 1/1991 | Allen | 264/184 |
| 5,023,035 | 6/1991 | Yang | 264/210.8 |

FOREIGN PATENT DOCUMENTS

| | | |
|---|---|---|
| 59-116411 | 7/1984 | Japan . |
| 1408262 | 10/1975 | United Kingdom . |

*Primary Examiner*—Paul R. Michl
*Assistant Examiner*—Peter Szekely

[57] ABSTRACT

A process is disclosed for heating never-dried para-aramid fibers containing 20 to 200 wt % water, based on dry polymer weight to form a fiber having a modulus of greater than 800 gpd while retaining a high tenacity. The fibers are heated in one or more microwave resonant cavity applicators to a temperature of 250° C. to 425° C. and preferably 270° C. to 310° C. while under a tension of 0.2 to 10 grams per denier. The preferred para-aramid is poly(p-phenylene terephthalamide). Fibers having a density of less than 1.43 g/cc can be made; and fibers having moduli greater than 1100 gpd can be made.

14 Claims, 4 Drawing Sheets

PROCESS FOR MAKING PARA-ARAMID FIBERS HAVING HIGH TENACITY AND MODULUS BY MICROWAVE ANNEALING

FIELD OF THE INVENTION

The present invention relates to a process for rapidly heating as spun never-dried para-aramid fibers, such as fiber made from poly(p-phenylene terephthalamide), with a dielectric heater to produce fibers having high tenacity and modulus followed by various finishing steps which may include further heating with either a dielectric heater, or a radiation or convection oven followed by cooling and applying a finish.

PRIOR ART

U.S Pat. Nos. 3,869,429 and 3,869,430 disclose fibers of various aromatic polyamides including poly(p-phenylene terephthalamide) (PPD-T) which can be or have been heat treated under moderate tension to yield fibers having high tenacity and high modulus.

Japanese Patent Application 59-116411 published Jul. 5, 1984 discloses PPD-T fibers with pores made by dissolving aliphatic polyamides, originally dissolved in the spin dope, from the structure of the fiber, as formed, with a solvent for the aliphatic polyamide which is a non-solvent for the PPD-T. Example 3 of the reference discloses a fiber having a density of 1.38 g/cc, a single filament strength of 24 gpd, an elongation of 2.5% and a Young's modulus of 870 gpd.

U.S. Pat. No. 4,883,634 discloses a heat treatment of never-dried poly(p-phenylene terephthalamide) fibers by means of turbulent gas jets and radiant heat ovens to yield fibers of high modulus and high tenacity.

U.S. Pat. No. 3,557,334 discloses a microwave resonant cavity system having a three-port circulator coupled to a microwave power source, a water load and the resonant cavity. The system is disclosed as being suitable for heating a wet tow or yarn fed to and removed from the system by means of pairs of cooperating rolls.

SUMMARY OF THE INVENTION

The present invention relates to a dielectric heating process in which never-dried para-aramid fibers are rapidly heated to provide a filament having high tenacity, high modulus, and, under selected conditions, a reduced density.

The process involves the step of introducing never-dried aramid fibers to a first dielectric heating with microwave radiation of 100 to 10,000 megahertz ($MH_z$), typically 915 or 2450 MHz, to heat the fibers to 200° C. to 550° C. in 0.05 to 0.5 second. Upon removal from the microwave radiation, the fibers have a density of 1.30 to 1.43 g/cc or higher, a yarn tenacity of more than 20, typically 20 to 30 grams per denier (gpd), and a modulus of more than 800, typically 800 to 1200 gpd. The fibers can then be subjected to further processing such as cooling and applying a finish.

In a preferred aspect of the process, the fibers leaving the above-described dielectric heating step still contain more than 20, typically 20 to more than 100 weight percent moisture and are subjected to a second dielectric heating step which heats the fibers to as high as 550° C. and provides fibers with a higher modulus of as much as 1200 gpd or more.

Alternatively two dielectric heaters may be used to heat the fibers to more than 500° C. using a 915 or 2450 $MH_z$ first unit and a 2450 $MH_z$ second unit. This alternative results in fibers having moduli of greater than 1100 gpd and densities of up to about 1.50 g/cc.

Alternatively, the fibers can be heated with one or two dielectric units in series with convective or radiant heaters to heat the fibers to more than 500° C. which also results in fibers having densities of up to about 1.50 g/cc and moduli of greater than 1100.

The present invention also relates to a low density filament of poly(p-phenylene terephthalamide) wherein the filament contains internal cracks substantially parallel with the longitudinal axis of the filament and having a length generally at least ten times the diameter of the filament wherein the cracks do not breach the surface of the filament and the cracks result in internal voids to yield filaments of a density of 1.36 to 1.43 g/cc.

Dry para-aramid material is not heated by microwave radiation and, of course, water is heated to its boiling temperature. It has been discovered that microwave radiation can be used to heat para-aramid fibers with water in the fiber structure to temperatures of from 100° to almost 500° C. degrees higher than the boiling temperature of water. The reasons for this surprising degree of heating are not completely understood.

DETAILED DESCRIPTION OF THE DRAWINGS

Figure 1:
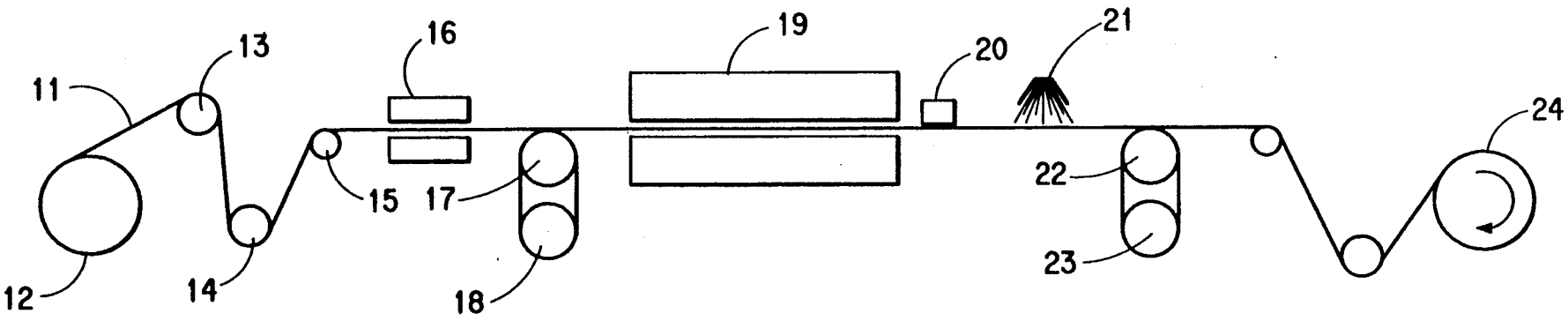
FIG. 1 is a schematic diagram of a single step heating process of the present invention.

Referring now to FIG. 1, never-dried yarn 11 from supply roll 12 is fed over rolling guides 13, 14 and 15 to assure the desired alignment of the yarn. The yarn is then fed through dewaterer 16. Generally, a dewaterer is a jet of high velocity air directed at the yarn, or a mechanical water stripper comprising a series of polished ceramic pins arranged such that the pins press lightly against the yarn to remove excess water. The excess water is generally water on the surface of the yarn. The use of dewaterer 16 is optional. From dewaterer 16, yarn 11 is fed to a first set of tension rolls 17 and 18. Dewaterer 16 can, also, be located after tension rolls 17 and 18 and before microwave resonant cavity applicator 19. The yarn generally makes from 5 to 12 wraps around rolls 17 and 18 and then passes into the microwave resonant cavity applicator 19 where it is dielectrically heated. The microwave energy absorbed by the yarn is adjusted in a manner described below to heat the yarn to the desired temperature as measured by temperature gauge 20 located at the exit of microwave resonant cavity applicator 19. A mild water spray 21 preferably is applied to cool the yarn and reduce any electrostatic charge which may be on the yarn. After the yarn passes onto a second set of tension rolls 22 and 23, typically set to produce a tension of 0.2–10 gpd and preferably 2–6 gpd, a finish could be applied (not shown) and the yarn is wound using a tension controlled winder 24.

Figure 2:
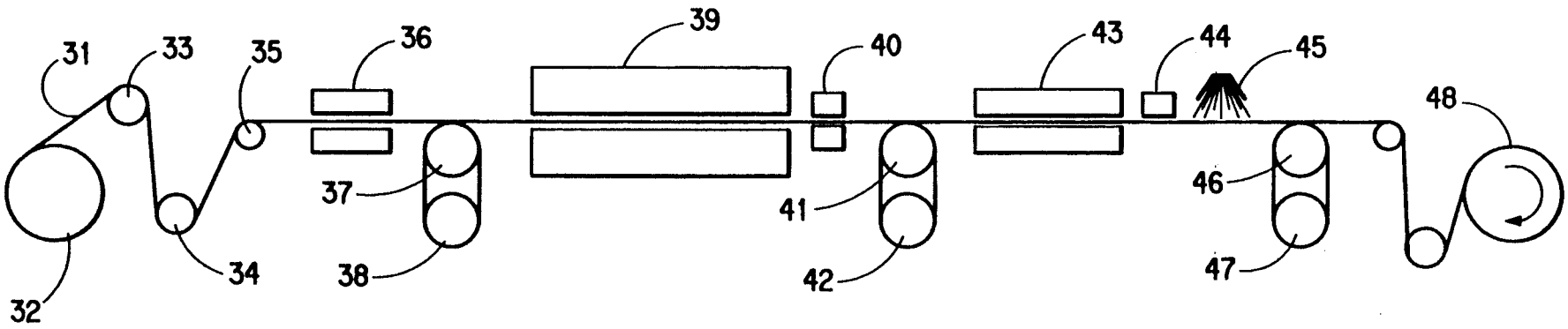
FIG. 2 is a schematic diagram of a two step heating process of the present invention.

Referring now to FIG. 2 a multiple stage heating system for carrying out the heating process of the present invention is depicted. Never-dried yarn 31 is removed from supply roll 32 and fed over rolling guides 33, 34, and 35 to provide the desired alignment of the yarn. The yarn then passes through dewaterer 36 similar to dewaterer 16 depicted in FIG. 1. From dewaterer 36, yarn 31 is fed to a first pair of tension rolls 37 and 38, which, again, may be positioned upstream of dewaterer 36. Yarn 31 then passes through microwave resonant cavity applicator 39 to heat yarn 31 to the desired temperature which is measured by temperature gauge 40 at the exit of microwave resonant cavity applicator 39. The yarn 31 then passes around a pair of tensioning rolls 41 and 42. Rolls 41 and 42 are optional and need only be used if it is desired to have yarn under a different tension in microwave resonant cavity applicator 39 than in heater 43 or if it is desired to heat or cool the yarn exiting microwave resonant cavity applicator 39. Optionally, tension rolls 41 and 42 can be internally heated or cooled. From tension rolls 41 and 42, yarn 31 passes through heater 43. Heater 43 may be another microwave resonant cavity applicator similar to applicator 39 or another type of heater such as a radiant heater or convective heater. From the exit of heater 43, yarn 31 passes by temperature gauge 44. A mild water spray 45 preferably is applied to cool the yarn and reduce any static charge on the yarn. After the yarn passes the final set of tension rolls 46 and 47 the yarn is wound under tension using a tension controlled winder 48.

Figure 3:
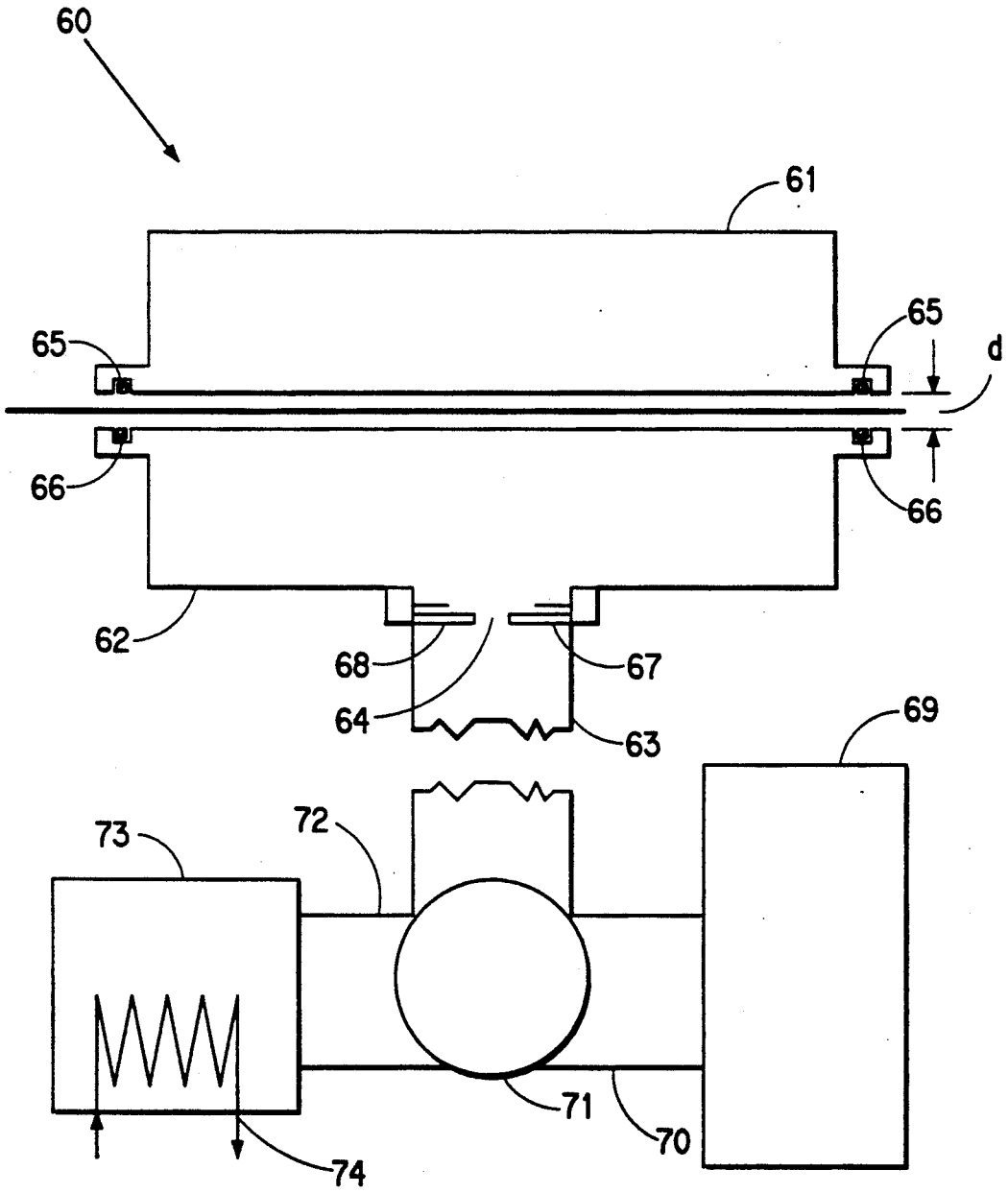
FIG. 3 is a schematic depiction of the microwave resonant cavity applicator used in the first step of the present invention.

FIG. 3 depicts a rectangular microwave resonant cavity applicator indicated generally at 60 suitable for use in the present invention. The applicator comprises a cavity defined by an upper section 61 and a lower section 62. The upper section 61 and lower section 62 are spaced apart by distance "d" used to tune the resonant frequency of the cavity to match that of the magnetron to excite a predetermined TM 11n mode. Upper section 61 is mounted so that it can be moved closer and further with respect to lower section 62 to tune the frequency of the cavity to the desired value. The base of lower section 62 is fitted with a waveguide 63 which includes an interchangeable iris 64 adjacent to lower section 62. The preferred microwave resonant cavity applicator of the present invention is open all around by having upper section 61 and lower section 62 uniformly spaced apart with no interfacing element there between. In order to provide a magnetic field containment barrier for electromagnetic energy stored in the cavity during operation of the applicator, there are continuous arrays, 65 and 66, of sections of ferrite materials implanted in the peripheral edges of upper section 61 and lower section 62. While the width of the ferrite arrays, 65 and 66, is not critical, the location of the arrays, 65 and 66 with respect to the cavity edges is important to limit the electromagnetic field leakage below 1 $mW/cm^2$ at the operating conditions while avoiding overheating of the ferrite arrays.

Cavity size defined by sections 61 and 62 should be designed to support a TM 11n mode and the desired resonant condition at the center frequency which is generally 915 $MH_z$ or 2450 $MH_z$. The width and height of the cavity formed by sections 61 and 62 is selected so that resonance at the next adjacent mode frequency is sufficiently far removed to make it unlikely that it would be excited by the effect of an extreme product moisture variation or source frequency change.

The end of wave guide 63 includes probes 67 and optional probe 68, both of which extend into wave guide 63 and of which 67 is threaded and rotatable so that its degree of extension into waveguide 63 is adjustable to facilitate impedance matching. This arrangement allows a change in the degree of coupling without disassembly of the system; and a compensation in the load on the system by merely turning threaded probe 67. In operation, microwave energy passes from magnetron 69 through waveguide 70, through circulator 71, waveguide 63, and iris 64 into the base of section 62 and the cavity defined by sections 61 and 62. Reflected power is returned through waveguide 63, circulator 71 and waveguide 72 to a water load 73 for power absorption and conversion to heat. Heat is removed from water load 73 by means of heat exchanger 74.

In operation to heat never-dried fibers, the system can be tuned by adjusting distance "d" between sections 61 and 62. Steam is generated as the fiber is heated and must be either removed as a vapor or condensed into a liquid and removed. The steam does not interfere with operation of the device. In fact, having a steam atmosphere is seen to promote better tensile properties in the yarn than an air or inert atmosphere. The steam can be removed by several means. For example, the surface of the cavity defined by sections 61 and 62 can be maintained at a temperature above the ambient dew point; or the cavity can be continually purged with a gas, such as air or nitrogen. The lower section 62 can, also, be shaped so as to provide for drainage of condensate.

Figure 4:
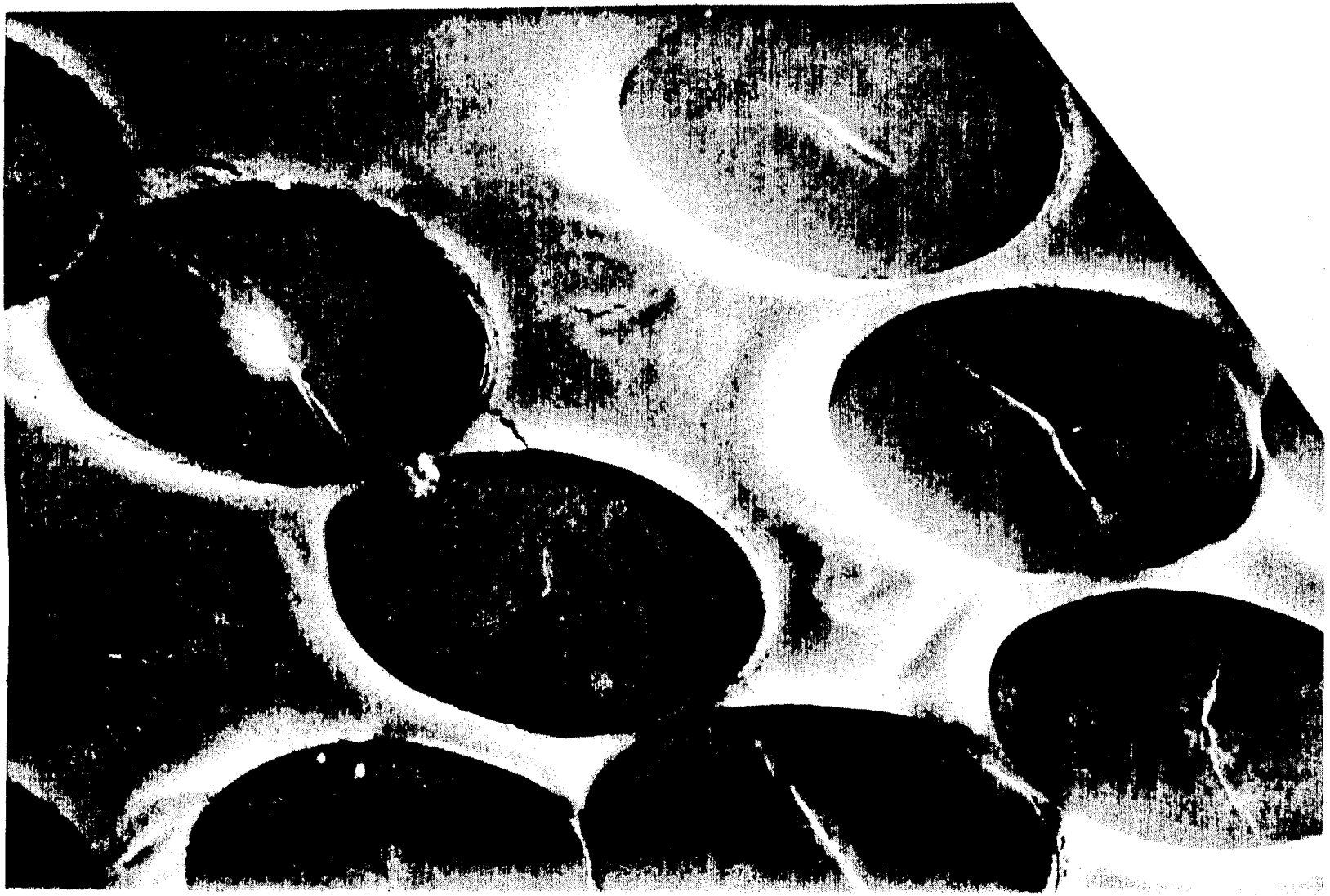
FIG. 4 is a photomicrograph of a diagonal cross section of a fiber of this invention.

FIG. 4 is a photograph of a cross section of a para-aramid fiber made by a process of this invention. The cross-sectional cut was made at an angle of 45° with the axis of the fiber. The fibers of this FIG. 4 were heated, at a rate of about 2000° C./sec, to a temperature of about 300° C. Note that the fibers have internal cracks which do not extend through the fiber surface. The cracks are longitudinal and result in fibers having a density of less than 1.42 g/cc.

The low density fibers of this invention are believed to be primarily the result of long internal cracks with much the same shape as can be seen in cross sections of dried logs of wood except that the cracks do not generally penetrate the surface of the fiber unless the fiber has been heated above about 300° C. Fiber cross sections show that these cracks generally extend across the center of the filaments and appear to be thin triangles joined at their narrowest side by other such triangles at the center of the fiber. Mostly, the cracks appear to be crescent-like but may have three lobes. They do not continue unbroken along the full length of the filament, but a given crack length is usually quite long relative to the diameter of the filament ($>10\times$). As the fiber is heated to higher temperatures of above 300° C., the cracks begin to break through the skin of some of the filaments. At high heating temperatures (above 500° C.) practically all of the fibers will have cracks which penetrate the filament skin. As the heating increases, the density of the product fibers increases from a low of about 1.3 g/cc at heating temperatures of about 300° C. to about 1.48 g/cc at 550° C.

DETAILED DESCRIPTION OF THE INVENTION

Para-aramids are the primary polymers in fibers of this invention and PPD-T is the preferred para-aramid. By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or perhaps slightly higher, provided only that the other diamines and diacid chlorides have no reactive groups which interfere with the polymerization reaction. PPD-T, also, means copolymers resulting from incorporation of other aromatic diamines and other aromatic diacid chlorides such as, for example, 2,6-naphthaloyl chloride or chloro- or dichlorotetraphthaloyl chloride; provided, only, that the other aromatic diamines and aromatic diacid chlorides be present in amounts which permit preparation of anisotropic spin dopes. Preparation of PPD-T is described in U.S. Pat. Nos. 3,869,429; 4,308,374; and 4,698,414; and spinning of aramid fibers is described in U.S. Pat. No. 3,767,756.

Inherent Viscosity (IV), as reported herein, is determined by the equation $IV = \ln(\eta_{rel})/c$ where c is the concentration (0.5 g of polymer in 100 ml concentrated sulfuric acid (96% $H_2SO_4$)) of the polymer solution and $\eta_{rel}$ (relative viscosity) is the ratio between the flow times of the polymer solution and the solvent at 30° C. in a capillary viscometer.

Suitable solvents for para-aramid dopes to make the fibers useful in practice of the present invention include sulfuric acid, chlorosulfuric acid, fluorosulfuric acid and mixtures of those acids. Minor proportions of hydrofluoric acid, trifluoromethane sulfonic acid, p-chlorosulfonic acid, or 1, 1, 2, 2-tetrafluoroethane sulfonic acid may also be present. The sulfuric acid should have a concentration of at least about 98%. Fuming sulfuric acid can be used.

The dope used to spin the fibers for use in the present invention should contain less than 2% water and the polymer dissolved therein less than 1% water to minimize polymer degradation.

It is desirable that the extrusion of the dope result in a fiber containing a polymer having an IV of at least 2.5, preferably at least 3.0 and more preferably at least 4.0.

The dopes generally contain 30 to 50 g and preferably 44 to 46 g of para-aramid polymer per 100 ml sulfuric acid. Generally, extrusion temperature for the dope is 70° C. to 120° C., and is preferably about 70° C. Below 70° C. the dope solidifies and above 120° C. polymer degradation becomes a problem.

The spinneret generally will have holes from 0.1 to 3.0 mils (0.025 to 0.75 mm) diameter and will have a length of the capillary to diameter of the hole (L/D) ratio of 1.0 to 8.3.

The jet velocity of the dope passing through the spinneret capillaries is not critical and generally will vary from 17 ft/minute (fpm) (5.1 meters per minute) to 1,150 fpm (350 meters per minute).

The spin stretch factor (SSF) is the ratio of the velocity of the filament as it leaves the coagulating bath to the jet velocity. Spin stretch factors of 1 to 14 can be used. The low end of the SSF is limited by the ability of the filament to form uniform denier fibers. The upper limit of the SSF is limited by filament breakage. In general, increasing the SSF improves the tenacity of the resultant fiber.

It is essential that the spinneret face be separated from the coagulating bath by a fluid layer of gas or non-coagulating liquid such as toluene, heptane, and the like. The thickness of the fluid layer can be from 0.1 to 10 cm and preferably is about 0.5 to 2.0 cm.

Generally, the filaments are extruded downwardly into a tube located in a bath of the coagulating fluid. There normally is a roller or snubbing pin at the bottom of the tube around which the filaments pass and then up and out of the coagulating bath.

Satisfactory results can be obtained with coagulating baths which range from pure water and brine up to 70% $H_2SO_4$. Bath temperatures ranging from −25° to more than 28° C. have been used satisfactorily including baths up to 50° C. Preferably the temperature of the bath is kept below 10° C. and even more preferably below 5° C. to obtain the highest tenacity fibers.

It is important to wash the coagulated filaments to remove acid and achieve essentially neutral filaments, that is, free of acid or base. Water alone or combinations of water and alkaline solutions may be used for this purpose.

The washed, never-dried, filaments form the starting point for practice of the present invention.

By the term "never-dried", is meant para-aramid fibers which have been newly-spun and never dried to less than 20 weight percent moisture prior to operation of the process of this invention. While previously dried fibers containing less than 20 weight percent moisture can be heat treated by microwave radiation, the density reduction is not as great and tenacity and modulus are lower than when using never-dried fibers in the process of this invention. It is believed that previously-dried fibers with less moisture cannot successfully be treated by this process because the water transition from liquid to vapor internal to the fiber is required to produce the pressure forces needed for crack generation and consequent reduced fiber density. Generally the never-dried filaments contain from 0.2 to 2.0 g of internal water per gram of dry polymer.

The never-dried fibers preferably are run through a mechanical dewatering device such as a plurality of pins to remove much of the surface water present on the fibers. This helps to make the total water contained by the fiber more uniform which leads to more uniform heating in the first microwave resonant cavity applicator. The temperature entering the first microwave applicator generally is about 20° C. although temperatures of about 10° C. to 40° C. can readily be used satisfactorily.

The microwave resonant cavity applicators generally are tuned to frequencies of 100 to 10,000 $MH_z$. Because of Government regulation and the present availability of magnetron power sources, the frequency normally is 915 or 2450 $MH_z$.

PPD-T fibers of the prior art have a density of about 1.44 to 1.48 g/cc. By the process of this invention high modulus PPD-T fibers can be made having densities over the range of about 1.3 g/cc to about 1.48 g/cc with tenacities at given moduli equivalent to or greater than those resulting from other heat treating methods.

To make fibers having a density less than 1.44 g/cc and a modulus greater than 800 gpd, the fibers are heated to 250° C. to 425° C. and preferably 270° C. to 310° C. in 0.05 to 0.5 second in one or more microwave applicators. The fibers are held under a tension of 0.2 to 10 gpd and preferably 2 to 6 gpd in the microwave applicator. For maximum density reduction, the heating rate of the fibers must be at least 1000° C. per second and might be as high as 5500° C. per second.

To make higher modulus and higher density fibers, at least two microwave resonant cavity applicators are preferred with higher frequency in the final applicator so that the fiber temperature can be increased to approach 550° C. for the highest modulus and density. Generally, the second applicator is located in series with the first applicator about ⅓ meter downstream from the first, and the fibers are conducted directly from one applicator to the next.

To reach the highest temperatures, it is necessary to carefully balance the heating load on the two applicators. There must be sufficient moisture in the yarn entering the second heater for the microwave energy to heat the yarn, otherwise the desired high temperature will not be reached. Conversely, if there is excessive moisture in the yarn, the field strength in the second unit will not be sufficient to reach the desired temperature. Due to difficulties in measuring moisture of a moving threadline, and product and equipment variations, this balancing is best done by adjustments while running rather than by specifying moistures and temperatures in advance. However, experience to date shows yarn temperatures exiting the first applicator of about 300° C. are adequate.

TEST METHODS

The amount of moisture included in a test yarn is determined by weighing a known length of yarn before and after drying. Denier is defined as the weight, in grams, of 9000 meters of the dry yarn.

Tenacity is reported as the breaking stress divided by denier of a fiber under test. Modulus is reported as the slope of a line running between the points where the stress-strain curve intersects the lines, parallel to the strain axis, which represent 11 and 17% of full load to break, converted to the same units as tenacity. Elongation is the percent increase in length at break. Both tenacity and modulus are first computed in gpd units which, when multiplied by 0.8838, yield dN/tex units. Each reported measurement is the average of 10 breaks.

Tensile properties for yarns are measured at 24° C. and 55% relative humidity after conditioning under test conditions for a minimum of 14 hours. Before testing, each yarn is twisted to a 1.1 twist multiplier (for example, a nominal 1500 denier yarn is twisted about 0.8 turns/cm). Each twisted specimen has a test length of 25.4 cm and is elongated 50% per minute (based on the original unstretched length) using a typical recording stress/strain-device.

The twist multiplier (TM) for a yarn is defined as:

$$TM=(tpi)(denier)^{-\frac{1}{2}}(73)=(tpi)(dtex)^{-\frac{1}{2}}/(30.3)$$

wherein tpi = turns per inch tpc = turns per centimeter

DENSITY

Fiber Density is determined using the density-gradient procedure described in ASTM D1505-85. The density limits of this invention can be tested using carbon tetrachloride and toluene in the density-gradient column. Yarn test specimens are made by tying a loose knot in a sample yarn and cutting the yarn on each side of the knot. The knot specimen is preconditioned at 105° C. for 15 minutes; and the yarn density is determined graphically after the yarn specimens reach the equilibrium level in the density-gradient column.

Fibers exiting the first microwave applicator can be fed around a pair of tension rolls and then through a second heater. A second pair of tension rolls may be used between the heaters if it is desired to have a tension applied to the fibers in the second heater different from the tension applied to the fibers when passing through the initial microwave applicator. If the tension applied to the fibers in both heaters is to be the same, these tension rolls (41, 42, FIG. 2) may be eliminated unless their presence is desired to alter the temperature of the fibers exiting the first applicator.

The process of this invention can be used to produce high modulus para-aramid fibers exhibiting high tenacity with the usual density of 1.44 to 1.48 g/cc or with lower density of less than 1.44 g/cc; and the process can be used to produce fibers of even higher modulus and high density, by controlling heating rates and final fiber temperature.

For para-aramid fibers having a modulus less than about 1100 grams per denier, a single high-frequency microwave resonant cavity will suffice to heat the fiber up to about 400° C. However, two microwave resonant cavities may be employed if the heating load requires it. Fiber density will not be reduced if the heating rate is below about 1000° C. per second. For low density fibers, the heating rate must exceed 1000° C. per second and the maximum fiber temperature must be between 250° C. and 425° C., preferably 270° C. to 310° C.

When the fibers are, thus, rapidly heated, they undergo a decrease in density which is due to generation of internal longitudinal pores or cracks. The surface of these fibers remain intact and is not breached by the cracks. At fiber temperatures above about 310° C., and particularly above 425° C., however, these cracks tend to reach the surface with the result that the apparent fiber density is increased above 1.42 g/cc.

For fibers with moduli greater than 1100 grams per denier, higher temperatures are required than can be easily obtained using a single microwave resonant cavity and practical industrial frequencies. These higher temperatures can be reached by passing the fibers through two or more microwave resonant cavities in series. With proper control, temperatures of 550° C. can, thereby, be reached, resulting in fibers having modulus up to 1200 grams per denier and densities up to about 1.50 g/cc.

An alternative process for obtaining fiber temperatures of 550° C. and higher is to pass the fiber through one or more microwave resonant cavities followed by either a convective or radiant heater.

In addition to high modulus and density, these fibers heated to 550° C. have very low moisture which is desirable for use in reinforcing composites made with thermoplastic or thermoset resins as opposed to elastomers.

After exiting the final heater, the fibers preferably are sprayed with water to reduce the temperature and static charge. The spray can, if desired, contain a finish composition for the filaments. The fibers are then fed around a final pair of tensioning rolls and finally taken up on a roll or other suitable means.

EXAMPLES

The yarn used in all of the examples was poly(p-phenylene terephthalamide).

EXAMPLE 1

A bobbin of never-dried yarn containing approximately 0.85 gram of water per gram of dry yarn was fed at 400 yards per minute (ypm) (366 m/min) to off-line heating equipment depicted in FIGS. 1 and 3. The microwave energy was supplied by a 30 kW 915 $MH_z$ magnetron to a 17 inch (0.43 m) wide by nominal 7 inch (0.18 m) deep by 35 inch (0.89 m) long TM 110 mode rectangular resonant cavity applicator which was water jacketed and maintained at 75° C. to 80° C. The waveguide was purged with a small flow of 400° C. air to prevent moisture accumulation. A 2 inch (5.08 cm) rectangular iris was determined by trial and error to make the system resonate in the desired range. With the yarn running through the cavity, the power was adjusted to 3.5 kW and the upper section was raised and lowered until resonant frequency tuning was reached for an exit yarn temperature of 300° C. The tension applied to the yarn was 2 gpd. At this time a sample was collected and later tested with the following results: Denier, 370; Tenacity, 24.58 gpd; Elongation, 2.56%; Initial Modulus, 870 gpd; and Density, 1.363 g/cc. The nominal heating rate was 2000° C./second based on the residence time in the applicator. However, the instantaneous heating rate may be much faster early in the heating cycle because the heating rate subsides as water is removed.

EXAMPLE 2

Equipment similar to that described in Example 1 (except that the cavity was 17 inches (0.43 m) wide by nominal 7 inches (0.18 m) deep by 25 inches (0.63 m) long) was used to demonstrate that the applicator design, when operated in the TM 110 mode, could uniformly heat multiple ends over a 3 inch (7.62 cm) width. Four nominal 1140 denier, never-dried, threadlines were fed at 400 ypm (366 m/min) under a tension of about 4 gpd and the yarn exit temperature adjusted to goal (250° C. to 290° C.). The temperature of each threadline was determined by the use of an infra-red instrument. Regardless of where the threadlines were spaced over the 3 inch (7.62 cm) width in the center of the applicator, no differences in their temperature could be detected.

COMPARATIVE EXAMPLE A

A yarn of 1000 denier which had been dried on hot rolls to a moisture level of about 0.06 grams per gram of dry yarn, was fed to a microwave resonant cavity heating system similar to that described in Example 1 except that the 915 $MH_z$ applicator was 25 inches (0.635 m) long. The yarn speed was 200 ypm (183 m/min.) and the tension was 3.5 gpd. The yarn was heated to 400° C. (overall heating rate=1920° C./sec.). A sample was collected and tested with the following results: Denier, 917; Tenacity, 18.75 gpd; Elongation, 2.28%; Modulus, 741 gpd; and Density, 1.432 g/cc.

Thus, while the density was at the expected value based on final yarn temperature, tenacity and modulus are depressed compared to similar treatment of never-dried yarn.

EXAMPLE 3

Microwave heat treating of poly(p-phenylene terephthalamide) yarns was coupled directly with spinning by replacing the hot rolls on a spinning unit with a 2450 $MH_z$ dielectric heating system having a TM 010 mode 22 inch (0.56 m) long circular cross-section microwave resonant cavity applicator similar to that described in U.S. Pat. No. 3,557,334. Hot water was circulated in the jacket to prevent water from condensing on the walls of the applicator. A nominal 380 denier (dry yarn basis) "never-dried" yarn containing about 1 gram of moisture per gram of dry yarn was heated to about 290° C. under a tension of about 3.8 gpd by adjusting the cavity resonant frequency tuning. The exposure time in the applicator was 0.08 seconds. The overall heating rate was 3625° C./second. The results were: Denier, 381; Tenacity, 21.85 gpd; Elongation, 2.05%; Modulus, 979 gpd; and Density, 1.420 g/cc.

In a separate test, with a vertically mounted unit, it was found that, even with unheated walls and with no air or nitrogen purge, condensation would drain harmlessly from the lips of the applicator provided measures were taken to conduct the drainage away from contacting the threadlines and from getting into the waveguide or iris.

EXAMPLE 4

A second microwave resonant cavity applicator was used as depicted in FIG. 2. The first microwave resonant cavity applicator was identical with the one described in Example 2 (915 $MH_z$, TM 110 mode, 50 kW) but with the power adjusted to provide exit yarn temperatures reported in Table A below. The second microwave resonant cavity applicator, similar to that described in Example 3, had a length of 10 inches (0.254 m). In each run the yarn was a 1140 denier (dry basis) containing 1 gram of water per gram of dry yarn. The power to the second microwave applicator and the cavity spacing were adjusted to provide the yarn exit temperatures reported in Table A below. The yarn speed through the microwave applicators was 400 ypm (366 m/min) in each run. At this speed, the residence time of the yarn in the first microwave applicator was 0.104 second and 0.042 second in the second dielectric applicator. Properties of the yarns produced are given in Table B.

TABLE A

| | Dielectric Heater 1 | | | Dielectric Heater 2 | | |
|---|---|---|---|---|---|---|
| Run | Exit Yarn Temp. °C. | Heating Rate °C./sec | Tension gpd | Exit Yarn Temp. °C. | Heating Rate °C./sec | Tension gpd |
| 4a | 135 | 1058 | 6 | 290 | 3690 | 6 |
| 4b | 135 | 1058 | 4 | 290 | 3690 | 4 |
| 4c | 135 | 1058 | 7.9 | 290 | 3690 | 7.9 |
| 4d | 130 | 1010 | 6 | 290 | 3810 | 6 |
| 4e | 285 | 2500 | 2.8 | 335 | 1190 | 2.8 |
| 4f | 110 | 817 | 6 | 290 | 4560 | 1 |
| 4g | 110 | 817 | 6 | 290 | 4512 | 6 |
| 4h | 110 | 817 | 6 | 270 | 4080 | 2.1 |
| 4i | 110 | 817 | 6 | 270 | 4200 | 6 |
| 4j | 110 | 817 | 2 | 310 | 5280 | 2 |
| 4k | 110 | 817 | 2.1 | 310 | 5136 | 3.9 |
| 4l | 130 | 1010 | 2.1 | 310 | 4800 | 2.1 |
| 4m | 25 | 0 | 2.1 | 305 | 3768 | 1.8 |
| 4n | 310 | 1370 | 6.1 | 350 | 481 | 6.1 |
| 4o | 300 | 1886 | 8.3 | Heater Shut Off | | |

TABLE B

| Run | Tenacity gpd | Modulus gpd | Elongation % | Density g/cc |
|---|---|---|---|---|
| 4a | 24.52 | 931 | 2.3 | 1.417 |
| 4b | 23.97 | 874 | 2.39 | 1.416 |
| 4c | 23.86 | 959 | 2.16 | 1.407 |
| 4d | 23.93 | 1002 | 2.23 | 1.394 |
| 4e | 24.05 | 851 | 2.51 | 1.402 |
| 4f | 24.92 | 853 | 2.64 | 1.392 |
| 4g | 22.3 | 902 | 2.18 | 1.404 |
| 4h | 23.58 | 856 | 2.4 | 1.408 |
| 4i | 25.38 | 898 | 2.42 | 1.402 |
| 4j | 22.33 | 821 | 2.39 | 1.385 |
| 4k | 23.19 | 879 | 2.29 | 1.4 |

TABLE B-continued

| Run | Tenacity gpd | Modulus gpd | Elongation % | Density g/cc |
|---|---|---|---|---|
| 4l | 23.53 | 962 | 2.18 | 1.41 |
| 4m | 23.91 | 931 | 2.31 | 1.404 |
| 4n | 22.87 | 1044 | 2.01 | 1.42 |
| 4o | 26.78 | 802 | 2.86 | 1.432 |

EXAMPLE 5

Two microwave resonant cavity applicators, identical with those of Example 4 were used. The applicators were spaced about 1 foot (⅓ meter) apart and were adjusted, as indicated below, to produce very high modulus, high density, 1140 denier yarn from never-dried yarn containing 1 gram water per gram dry yarn. Yarn speed through the applicators was 200 ypm (183 m/min) at tension of 4.4 grams/denier. Both applicators were purged with steam and condensation was avoided by maintaining heat on the walls of the applicators. Yarn temperature was 290° C. exiting the first applicator and 500° C. exiting the second applicator. Yarn tenacity was 21.91 gpd, elongation was 1.65%, and modulus was 1191 gpd. Fiber density exceeded 1.47 g/cc. Inherent viscosity was 5.59.

EXAMPLE 6

A combination of dielectric and convective/radiant heating units was used to produce high modulus, high density, 380 denier yarn. Never-dried yarn containing 1 gram water per gram of dry yarn polymer was fed through the microwave applicator of Example 3 which was followed by a set of tension rolls as depicted in FIG. 2 and a 12 foot (3.7 meter) long, 6 inch (15 mm) diameter convective/radiant heater through which steam at 594° C. was circulated counter to the direction of yarn travel. Yarn speed was 200 ypm (183 m/min). Yarn tension was 6.3 gpd in the microwave resonant cavity applicator and 2.2 gpd in the convective/radiant heater. Yarn temperature exiting the microwave unit was 300° C. The intermediate tensioning rolls were heated to prevent yarn heat loss prior to entering the oven. Yarn tenacity was 19.65 gpd, elongation 1.48%, and modulus 1147 gpd. Density was 1.47 g/cc. Inherent viscosity was 7.35.

We claim:

1. A process comprising:

a) feeding never-dried para-aramid fibers containing from 0.2 to 2.0 grams of water per gram of dry filament to at least one microwave resonant cavity applicator operated at frequencies of from 100 to 10000 MHz and b) thereby, heating the fibers, at a rate at least 1000° C. per second, to a temperature of from 200° C. to 550° C. in 0.05 to 0.5 second while the para-aramide fibers are under a tension of at least 0.2 grams per denier to provide fibers having a modulus of at least 800 grams per denier.

2. The process of claim 1 wherein the microwave heating is done with a single microwave resonant cavity applicator.

3. The process of claim 1 wherein the fibers are formed of poly(p-phenylene terephthalamide).

4. The process of claim 1 wherein the para-aramid fibers are passed around dewatering pins prior to being fed into the microwave resonant cavity applicator.

5. The process of claim 1 wherein the para-aramid fibers are sprayed with a mild water spray upon exiting the microwave resonant cavity applicator.

6. The process of claim 1 wherein the fibers are heated to from 270° C. to 310° C. at a rate of at least 1000° C. per second.

7. The process of claim 6 wherein the para-aramid is poly(p-phenylene terephthalamide) and the fibers have a density of less than 1.43 g/cc.

8. The process of claim 1 wherein the fibers are heated by two serially arranged microwave resonant cavity applicators to a temperature of at least 425° C.

9. The process of claim 1 wherein the fibers are heated by a microwave resonant cavity applicator followed by a radiant/convective heater to a temperature of at least 425° C.

10. The process of claim 8 wherein the fibers are formed of poly(p-phenylene terephthalamide).

11. The process of claim 9 wherein the fibers are formed of poly(p-phenylene terephthalamide).

12. The process of claim 10 wherein the paraaramid fibers are sprayed with a mild water spray upon exiting the second microwave resonant cavity applicator.

13. The process of claim 11 wherein the paraaramid fibers are sprayed with a mild water spray upon exiting the radiant/convective heater.

14. A filament consisting essentially of poly(p-phenylene terephthalamide) and having a longitudinal axis and a diameter wherein the filament contains internal cracks substantially parallel with the longitudinal axis and each crack having a length generally at least ten times the diameter of the filament wherein the cracks, (i) do not breach the surface of the filament; and (ii) result in internal voids to yield filaments of a density of 1.36 to 1.43 g/cc.

* * * * *